United States Patent [19]

Moser

[11] 4,078,486

[45] Mar. 14, 1978

[54] DOCTORING DEVICE WITH BLADE CUSHIONING MOUNT

[75] Inventor: Hans Rudolf Moser, Hofacker, Switzerland

[73] Assignee: Fritz Buser AG Maschinenfabrik, Switzerland

[21] Appl. No.: 658,844

[22] Filed: Feb. 17, 1976

[30] Foreign Application Priority Data

Feb. 24, 1975 Switzerland ..... 2264/75

[51] Int. Cl.[2] ..... B41F 15/44

[52] U.S. Cl. ..... 101/120; 101/123; 101/124

[58] Field of Search ..... 101/120, 119, 123, 124, 101/157, 169; 15/256.5, 256.51, 245; 118/126

[56] References Cited

U.S. PATENT DOCUMENTS

| | | | |
|---|---|---|---|
| 1,509,612 | 9/1924 | Ruckriegel | 15/256.51 X |
| 1,566,358 | 12/1925 | White | 101/169 X |
| 2,914,788 | 12/1959 | Smith et al. | 15/256.5 |
| 3,010,134 | 11/1961 | Goyette | 15/256.51 |
| 3,229,662 | 1/1966 | Means | 15/256.51 X |
| 3,778,861 | 12/1973 | Goodnow | 15/256.51 |
| 3,859,690 | 1/1975 | Brown | 15/256.51 |
| 3,878,780 | 4/1975 | Lotte | 101/119 |
| 3,901,146 | 8/1975 | Stierlein | 101/120 X |

FOREIGN PATENT DOCUMENTS

| | | | |
|---|---|---|---|
| 2,414,226 | 10/1974 | Germany | 101/120 |
| 2,237,103 | 4/1973 | Germany | 101/120 |

*Primary Examiner*—Ronald E. Suter
*Attorney, Agent, or Firm*—Weingarten, Maxham & Schurgin

[57] ABSTRACT

A doctoring device for a printing block such as a screen stencil. The doctor profile frictionally holds the doctor blade which is both reversible and replaceable. An elastomer profile may be provided to resiliently support a portion of the doctor blade adjacent its working edge.

1 Claim, 3 Drawing Figures

A
1
2
3
4
5
6
7
8
9
10
11
12
13
14
15
16

DOCTORING DEVICE WITH BLADE CUSHIONING MOUNT

FIELD OF THE INVENTION

The invention relates to a doctoring device for a printing block, particularly a screen stencil with a doctor profile and a doctor blade removably fitted to the said doctor profile.

DISCUSSION OF THE PRIOR ART

A large number of different constructions of doctoring devices are known. One known doctoring device for screen stencils comprises an elastomer member fitted in a doctor holder, whereby a steel doctor blade is fixed to the elastomer member. Substantially only adhesion or vulcanization can be used for connecting the elastomer member and the doctor blade together in such a device. However, both these processes must be very carefully performed and are therefore costly. In addition, the replacement of the steel doctor blade, when it becomes worn, is relatively difficult so that generally the whole doctoring device has to be replaced. Despite good operating experience, these disadvantages are often not taken into consideration and the cost of using such doctoring devices is thereby increased.

SUMMARY OF THE INVENTION

The present invention provides a doctoring device of the type described hereinbefore, having such construction that when the doctor blade becomes worn it is not necessary to replace the whole doctoring device but only the blade itself, whereby such replacement can be performed rapidly and without tools. In addition, the two longitudinal edges of the doctor blade can be used so that the service life thereof is considerably increased. The operating cost for the present doctoring device is substantially improved over those of the prior art.

According to the invention a slot is formed on the doctor profile which is bounded by a clamping surface on the doctor profile, by a stop on the clamping surface and by a clamping bar, wherein part of the width of the doctor blade is inserted into the said slot and is retained therein by frictional means.

BRIEF DESCRIPTION OF THE DRAWING

The objects, features and advantages of the present invention will be apparent from the following description when read in conjunction with the accompanying drawing in which.

DETAILED DESCRIPTION OF THE PREFERRED EMBODIMENTS

Figures 1, 2, 3:
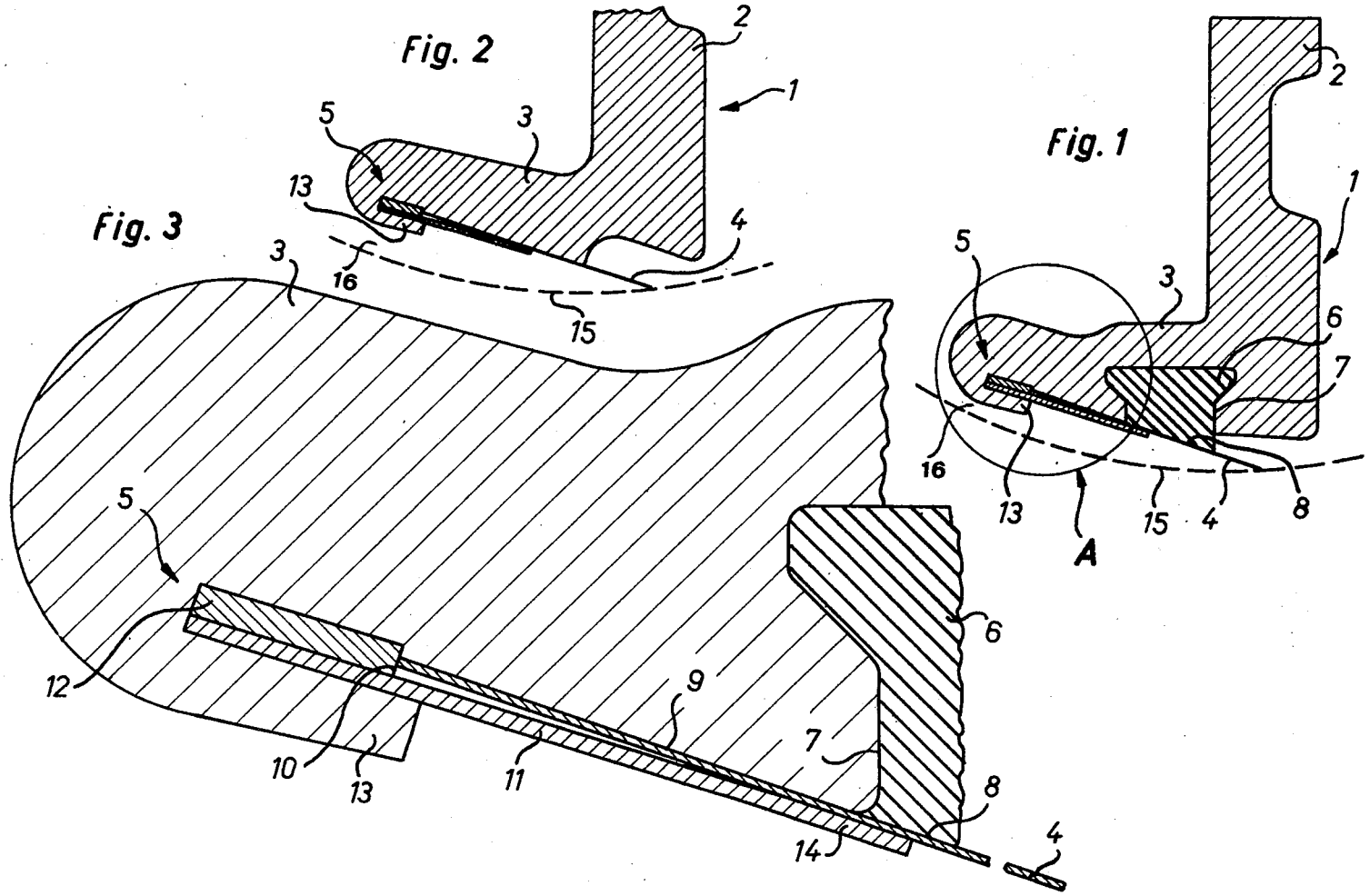
FIG. 1 is a section through a doctoring device in which the doctor blade engages on a stop face of the doctor profile and on an elastomer profile.
FIG. 2 is a section through a further doctoring device in which no elastomer profile is used, but where otherwise the construction coincides with the doctoring device of FIG. 1.
FIG. 3 shows a larger scale section through that part of the doctoring device of FIG. 1 indicated therein by the reference letter A.

FIG. 1 shows an angular doctor profile 1, whereon one member 2 serves to secure the doctoring device in a doctor holder (not shown) which is fixed to a doctor holder tube (also not shown). The other member 3 of the doctor profile 1 carries a doctor blade 4 made, for example, from steel sheeting and whose one longitudinal edge is inserted in a slot 5, to be described in greater detail with reference to FIG. 3. The blade is partially supported in member 3 and partially on a profile 6 which is made from an elastomer such as rubber. The elastomer profile 6 is inserted in an opening 7 provided in member 3 and is appropriately secured in positive locked manner by such means as a dovetail-shaped construction of opening 7. Advantageously the outer surface 8 of profile 6 is approximately coplanar with the adjacent contour of member 3. The doctoring device of FIG. 2 coincides with that of FIG. 1, but the doctor blade 4 is only supported on member 3 because an elastomer cushion such as profile 6 in FIG. 1 is not provided.

FIG. 3 shows on a larger scale that portion of FIG. 1 indicated by the reference letter A. Slot 5 is formed by clamping surface 9, a stop 10 for doctor blade 4 and a clamping bar 11. As already indicated, clamping surface 9 continues in an approximately coplanar manner into the outer surface 8 of elastomer profile 6 located in opening 7 shown only partly in FIG. 3.

Stop 10 can be formed integrally with member 3. Since, however, the doctor profile 1 is advantageously made from a light metal alloy, stop 10 can alternatively be formed by a stop strip 12, made of a suitable material such as steel which is subject to less evidence of wear than would be a light metal stop. It is important to note that the stop 10 is surrounded by a tongue 13 of member 3 which also surrounds a portion of clamping bar 11 which presses against stop 10. By forming the slope of clamping surface 9 and that of the clamping bar 11, both extending from stop 10, such that they are different, that is, converging in such a way that the clamping bar 11 presses with its free end 14 against clamping surface 9, doctor blade 4 is secured to doctor profile 1 in a reliable manner. Consequently doctor blade 4 is inserted between clamping surface 9 and clamping bar 11 and is only held by friction contact. By securing the doctor blade 4 in this way, it can in advantageous manner be very easily removed and replaced or turned if the longitudinal edge engaging on stop 10 has not previously been used as the active doctor blade edge and is consequently unworn. The method of mounting according to FIG. 3 requires very little space because no screwed joint is needed. The elastomer profile 6 is used for cushioning doctor blade 4 but need not be used in certain applications for which purpose the embodiment of FIG. 2 is shown.

In FIGS. 1 and 2 the contour of a rotary screen stencil is shown in dotted line form and given the reference numeral 15. It can be seen that there is a sufficiently large gap 16 for the passage of the printing ink to the edge of the doctor blade even if the doctoring device is pivoted about an axis in the vicinity of the said edge with a view to reducing the doctor blade angle relative to stencil surface 15.

The invention is not limited to the embodiments described and represented hereinbefore and various modifications can be made thereto without passing beyond the scope of the invention.

What is claimed is:

1. A doctoring device for a printing block, particularly for a screen stencil, said doctoring device comprising:

a doctor profile having a clamping surface formed thereon, said surface terminating at an opening in said doctor profile;

a stop means in said doctor profile defining the inner end of said clamping surface;

a clamping bar extending from said doctor profile in confronting and converging relationship with said clamping surface, said clamping surface, said stop means and said clamping bar defining a slot;

a doctor blade having part of its width inserted in said slot and being held in place by frictional surface confronting contact with said clamping surface and said clamping bar, the free end of said clamping bar engaging the outer surface of said doctor blade intermediate its ends and confining said doctor blade between said clamping bar and said clamping surface; and a elastomer profile mounted within said opening in said doctor profile, said elastomer profile having a bearing surface contiguous and coplanar with said clamping surface, said elastomer profile resiliently supporting in surface confronting relationship a portion of the surface of said doctor blade adjacent the free end thereof for cushioning of said doctor blade;

wherein said doctor profile is formed with a tongue confining said stop means and one edge of said clamping bar, said clamping bar being pressed against said stop means by said tongue, said clamping surface being substantially planar, a substantial portion of said doctor blade from said inserted part of its width toward the free end thereof normally resting against said clamping surface and said elastomer bearing surface.

* * * * *